US005219524A

United States Patent [19]

Evans, II

[11] Patent Number: 5,219,524

[45] Date of Patent: Jun. 15, 1993

[54] SYSTEM AND METHOD FOR PRESERVING ACID-CONTAINING ARTICLES

[75] Inventor: Creed M. Evans, II, Great Falls, Mont.

[73] Assignee: Everseal Preservation Labs., Inc., Bozeman, Mont.

[21] Appl. No.: 696,852

[22] Filed: May 7, 1991

[51] Int. Cl.[5] ..... D06M 11/00

[52] U.S. Cl. ..... 422/40; 8/115.53; 8/116.1; 8/119; 162/160; 162/192

[58] Field of Search ..... 422/40; 8/116.1, 119, 8/115.53; 162/160, 192

[56] References Cited

U.S. PATENT DOCUMENTS

| | | | |
|---|---|---|---|
| 3,703,353 | 11/1972 | Kuster, Jr. et al. . | |
| 3,928,264 | 12/1975 | Young, Jr. et al. . | |
| 4,051,276 | 9/1977 | Williams et al. . | |
| 4,522,843 | 6/1985 | Kundrot . | |
| 4,619,735 | 10/1986 | Norton . | |
| 4,808,423 | 2/1989 | Mollett et al. . | |
| 4,863,566 | 9/1989 | Warren et al. . | |
| 4,927,497 | 5/1990 | Sharpe . | |
| 5,120,500 | 6/1992 | Eggersdorfer et al. | 422/40 |

OTHER PUBLICATIONS

Polyester Film Encapsulation (undated).
GPO Publication 0-299-578 (1980).
Abbey Newsletter, letter to the editor, Apr., 1986, p. 11.
Plastic Blowmolding Handbook, (1990).
Eastman Polyester Plastics for Packaging (undated).
Modern Plastics Encyclopedia (1990).
Abbey Newsletter, Feb., 1990, vol. 14, No. 1, p. 15.
Oxygen Indicator Ageless-Eye ® (undated).
Experiments with the "'Archivist's Pen'" Jun. 1990 Abbey Newsletter, vol. 14 #3, p. 45.

*Primary Examiner*—Robert J. Warden
*Assistant Examiner*—Timothy M. McMahon
*Attorney, Agent, or Firm*—Rothwell, Figg, Earnst & Kurz

[57] ABSTRACT

An article preservation system and method includes an acid-containing article which is contacted with an alkaline substrate material and an artificial atmosphere which is substantially free of gaseous oxygen. The article, alkaline substrate material and artificial atmosphere are hermetically sealed within an interior of a container, at least a portion of the container being at least partially transparent so as to permit viewing of the article from outside the container.

27 Claims, 1 Drawing Sheet

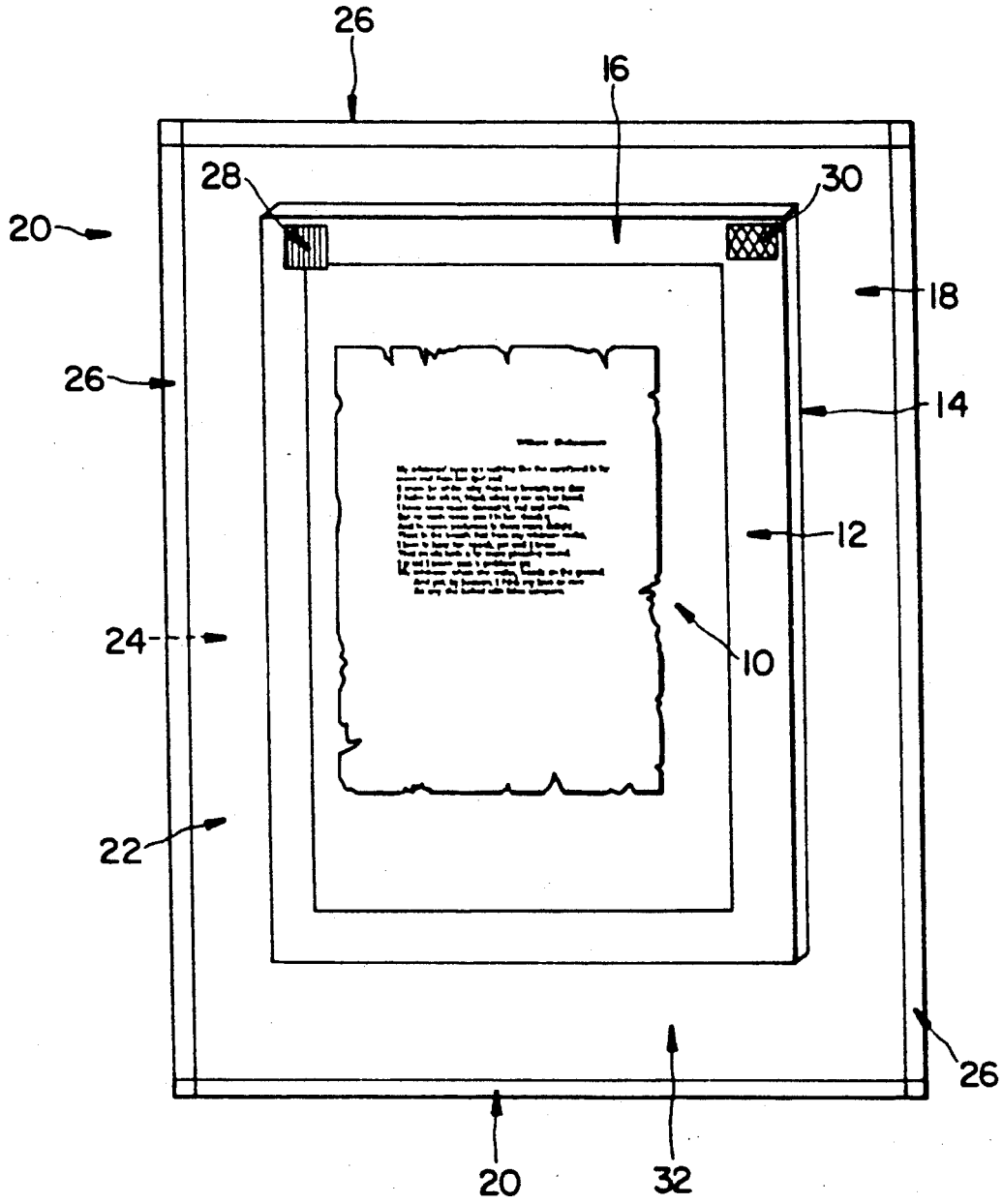
26
16
28
30
20
18
26
14
12
24
10
22
26
20
32

SYSTEM AND METHOD FOR PRESERVING ACID-CONTAINING ARTICLES

BACKGROUND OF THE INVENTION

1. Field of the Invention

The present invention relates to the preservation of acid-containing articles.

2. Description of the Background Art

Many acid-containing articles are vulnerable to destruction as a direct result of the acid contained therein. For example, most paper manufactured since the early nineteenth century contains acid. Such acid-containing paper deteriorates quite rapidly by yellowing, becoming increasingly brittle and finally disintegrating into dust, often within a matter of decades. In contrast, paper made without acid can last for centuries.

As aging, acid-containing paper increases in brittleness, it become more susceptible to damage during handling. Many documents of great value and importance, such as manuscripts, deeds, letters and the like, are printed on acid-containing paper. Destruction of such documents due to their acid content, represents a significant loss. In view thereof, numerous proposals have been made to prevent the age-related destruction of acid-containing paper documents, see, e.g., U.S. Pat. Nos. 3,703,353; 4,051,276; 4,522,843; 4,619,735; 4,808,433; 4,863,566; and 4,927,497.

One method utilized by the Library of Congress to conserve acid-containing paper documents is polyester film encapsulation. See, publication 1980 0-299-578, U.S. Government Printing Office. This method involves overlaying both sides of a document with polyester film sheets, and forming an envelope by sealing the polyester sheets around their edges ultrasonically or with tape. This U.S. Government publication indicates that documents that have been chemically deacidified and alkalized prior to polyester film encapsulation, can be preserved better than documents encapsulated without deacidification.

The most common methods used for deacidification of paper involve gaseous or liquid chemicals. However, chemical treatment of paper may be problematic for several reasons. The long term effects of any particular chemical treatment of paper are uncertain. With important paper documents disintegrating at an alarming rate, it may not be prudent to experimentally determine if a particular chemical will work to preserve the paper, or if it will destroy the document even further. The treatment of paper with chemicals generally is an irreversible process. The application of chemicals to paper is expensive and time consuming. Many of the chemicals are dangerous to use and environmentally hazardous. Additionally, documents which have been chemically deacidified are still vulnerable to air pollution and oxidative degradation by air.

While polyester film encapsulation of documents which have not been deacidified renders them resistant to destruction brought about by handling, the above-cited U.S. Printing Office publication 1980 0-299-578 indicates that encapsulated documents which have not been deacidified deteriorate at a faster rate than papers which have not been encapsulated. This is apparently due to the build up of degradative gases within the polyester envelope. Proposed solutions to this problem include providing air holes in the corners of the polyester envelope or leaving the envelope open along two edges thereof, to permit escape of degradative gases.

However, providing holes in the envelope has been shown not to slow down the faster rate of degradation of encapsulated acid-containing paper. While deterioration of encapsulated acid-containing paper is slower inside a polyester envelope which is open along two edges, it has still been found to be faster than that observed for unencapsulated controls, as reported by Shahani, C. J., Research Officer, Library of Congress, in a letter to the editor, *Abbey Newsletter*, April 1986, p. 11.

Another proposal has been to encapsulate a sheet of alkaline paper along with the acid-containing paper to be preserved. While this has been reported as slowing the deterioration of acid-containing paper, the degradative reaction still continues with the acid-containing paper degenerating faster than non-acidic paper.

Other acid-containing articles subject to degradation brought about by their acid contents include articles of leather, certain textiles, photographs and the like.

There thus remains an urgent need in the art for improved systems and methods for preserving acid-containing articles.

SUMMARY OF THE INVENTION

In accordance with the present invention, an article preservation system comprises an acid-containing article which is in contact with an alkaline substrate material and an artificial atmosphere which is substantially free of gaseous oxygen. The article, alkaline substrate material and artificial atmosphere are hermetically sealed within an interior of a container, at least a portion of which container is at least partially transparent so as to permit viewing of the article from outside the container.

BRIEF DESCRIPTION OF THE DRAWING

The single FIGURE is an elevational view, partly schematic, of an article preservation system in accordance with one embodiment of the present invention.

DETAILED DESCRIPTION OF THE PREFERRED EMBODIMENTS

With reference to the drawing, one embodiment of an article preservation system according to the present invention includes an acid-containing paper document 10, which can be any suitable article for preservation, such as a manuscript, deed, letter, baseball card, comic book, stamp, photograph or the like. While the invention is further described in detail with respect to paper articles, it is to be understood that the invention can be equally applicable to other acid-containing articles such as leather, textiles and the like.

Referring back to the drawing, an alkaline substrate material 12 is in contact with document 10. In the embodiment shown, the alkaline substrate material is a bed formed of sheets of alkaline paper comprising about 30% by weight calcium carbonate and about 70% by weight cellulose and alkalies. For one sided documents, the bed can include an alkaline backing sheet 14 contacting and covering the backside of document 10 and an alkaline top matte sheet 16 framing the top surface of document 10 to permit viewing thereof. Acid within document 10 migrates into the alkaline paper substrate 12 in contact therewith.

For double sided documents which require viewing on both sides, the alkaline paper substrate can be in matte form on both sides of document 10, sized to contact only the edges of document 10 so as to allow acid migration while permitting visibility of the document from both sides.

Document 10 and alkaline substrate material 12 in contact therewith are hermetically sealed within the interior 18 of a pouch or container 20. In the embodiment shown, container 20 is formed from two substantially transparent polymer sheets 22 and 24. In preferred embodiments, the polymer sheets are copolyester, most preferably PETG. In particularly preferred embodiments, each PETG sheet 22 and 24 is about 20 mils in thickness.

The PETG sheets 22 and 24 are sealed together about their edges by any suitable means. In preferred embodiments, sheets 22 and 24 have peripheral seals 26 formed by Radio Frequency Sealing. Seals 26 advantageously have a width of from about ⅛th inch to about ½ inch and do not contact the substrate material 12 or document 10.

In order to alert a viewer that the alkaline substrate material has reached the end of its useful life when sufficient acid has migrated from document 10 into substrate 12 so as to render the substrate acidic, a pH indicator 30 is sealed within the interior of container 20 in preferred embodiments. In particularly preferred embodiments, the pH indictor is colorimetric, and is applied directly to substrate 12 in liquid form and allowed to dry. The pH indicator can, for example, change color when the pH of the substrate is lowered to about pH 5.7 or less by migration of acid from document 10. One suitable colorimetric pH indicator is chlorophenol red.

To further remove acid from document 10, calcium carbonate particle 32 also can be sealed within the interior of container 20, and can be introduced therein with the artificial atmosphere.

In accordance with the present invention, document degradation brought about by the presence of gaseous oxygen is avoided by sealing an artificial atmosphere within container 20. The artificial atmosphere is substantially free of gaseous oxygen and in contact with document 10. In preferred embodiments, the artificial atmosphere includes at least one inert gas. In particularly preferred embodiments, the artificial atmosphere includes argon and helium, most preferably about 70% argon and about 30% helium.

As noted above, the artificial atmosphere within container 20 is substantially free of gaseous oxygen, i.e., contains less than about 40 ppm $O_2$, more preferably, less than about 30 ppm $O_2$, and most preferably less than about 15 ppm $O_2$.

In particularly preferred embodiments, the artificial atmosphere within container 20 is at a pressure slightly greater than earth's atmospheric pressure at sea level, for example, about one percent greater.

In accordance with one embodiment, an $O_2$ indicator 28 is sealed within the interior of container 20. The $O_2$ indicator 28 is capable of indicating the presence of gaseous oxygen in the interior of container 20. An $O_2$ indicator can be selected which is colorimetric and changes color if the oxygen content of the artificial atmosphere within container 20 is raised to about 0.5% gaseous oxygen. One suitable oxygen indicator is manufactured by Mitsubishi Gas Chemical Company and sold under the trademark AGELESS-EYE®, which changes from pink to blue if the gaseous oxygen concentration increases to about 0.5% or higher.

In particularly preferred embodiments, the document 10 and substrate 12 are sealed within container 20 in a zero humidity environment so that the interior of container 20 is substantially moisture free, to further reduce degradation of document 10.

Ultra violet (UV) radiation can also damage documents. Accordingly, one embodiment of the invention utilizes a UV inhibitor or UV blocker which is incorporated into polymeric sheets 22 and 24, or applied as a coating thereto. One suitable film material is sold by Kodak under the trademark ULTROS® PETG 6763.

In the method of the present invention, an acid-containing article is contacted with an alkaline substrate material and an artificial atmosphere which is substantially free of oxygen. The article, alkaline substrate material and artificial atmosphere are sealed within the interior of a container formed, for example, from PETG sheets, as noted above.

The present invention provides a safe and effective way to protect acid-containing articles, without subjecting the articles to liquid or gaseous chemical alteration. The colorimetric pH and $O_2$ indicators of the present invention provide easy means for alerting the user of changes in the sealed interior of the system which could deleteriously impact the longevity of the document. The invention is also a reversible process leaving a document in almost its original condition after removal from the container.

The present invention also provides a means for permitting libraries and document repositories to display important articles and documents to the public rather than hiding such articles and documents in environmentally controlled vaults.

The invention further permits private citizens to have their precious articles and documents protected, since the articles and documents can be sealed in accordance with the present invention and returned to the owner.

When polymer sheets of sufficient thickness (e.g., 20 mil) are utilized in accordance with the present invention, articles and documents are prevented from folding and creasing which further protects them from wear and tear. Hermetic sealing within the polymer enclosure also protects the articles and documents from water damage, smoke damage, insects, vermin, air pollution, bacterial agents and fungi.

In one particularly preferred embodiment, this invention will preserve books by inserting between each page of the book a very thin sheet of calcium/alkaline acid absorbing paper. The book will then be encapsulated in a preformed container of PETG with oxygen and acid detectors.

Since many modifications, variations and changes in detail may be made to the described embodiments, it is intended that all matter in the foregoing description and shown in the accompanying drawing be interpreted as illustrative and not in a limiting sense.

What is claimed is:

1. An article preservation system, comprising an acid-containing article which is in contact with an alkaline substrate material and an gaseous atmosphere which is substantially free of gaseous oxygen, the article, alkaline substrate material and gaseous atmosphere being hermetically sealed within an interior of a container, at least a portion of which container is at least partially transparent so as to permit viewing of the article from outside the container.

2. The system of claim 1 wherein said article is a paper document.

3. The system of claim 2 wherein the container is formed of substantially transparent polymer sheet material.

4. The system of claim 3 wherein the polymer sheet material is PETG sheet material.

5. The system of claim 3 wherein the polymer sheet material includes a UV blocker.

6. The system of claim 2 wherein said substrate is alkaline paper comprising calcium carbonate and cellulose.

7. The system of claim 6 wherein said substrate comprises about 30% calcium carbonate, and about 70% cellulose and alkalies.

8. The system of claim 2 wherein said atmosphere includes inert gas selected from the group consisting of argon, helium and mixtures thereof.

9. The system of claim 8 wherein the atmosphere comprises about 70% argon and about 30% helium.

10. The system of claim 2 further including an $O_2$ indicator sealed within the interior of said container, capable of indicating the presence of gaseous oxygen with said interior.

11. The system of claim 10 wherein said $O_2$ indicator is capable of indicating an $O_2$ content in the atmosphere of the interior of said container of about 0.5% $O_2$ or higher.

12. The system of claim 2 further including a pH indicator within the interior of said container capable of indicating when said substrate material becomes acidic.

13. The system of claim 2 wherein the interior of said container is substantially moisture free.

14. The system of claim 2 further including calcium carbonate particles sealed within the interior of said container.

15. A method of preserving an acid-containing article, comprising contacting the article with an alkaline substrate material and a gaseous atmosphere which is substantially free of gaseous oxygen, and hermetically sealing the article, alkaline substrate material and gaseous atmosphere within an interior of a container, at least a portion of which container is transparent so as to permit viewing of the article from outside the container.

16. The method of claim 15 wherein the article contacted with said substrate and sealed in said container comprises a paper document.

17. The method of claim 16 further including the step of forming said container from substantially transparent polymer sheet material.

18. The method of claim 16 further including the step of forming said container from substantially transparent PETG sheet material.

19. The method of claim 16 further including the step of forming said container from polymer sheet material including UV blocker.

20. The method of claim 16 wherein the step of contacting said paper document with said atmosphere comprises contacting said paper document with an atmosphere selected from the group consisting of argon, helium and mixtures thereof.

21. The method of claim 20 wherein an atmosphere comprising 70% argon and 30% helium is sealed within said container.

22. The method of claim 16 wherein the sealing step includes sealing an $O_2$ indicator within said container.

23. The method of claim 16 wherein the sealing step includes sealing a pH indicator within said container.

24. The method of claim 16 wherein said sealing step seals said container with the interior thereof substantially moisture free.

25. The method of claim 16 wherein the sealing step includes sealing calcium carbonate particles within the interior of said container.

26. An article preservation system, comprising an acid-containing article which is in contact with an alkaline substrate material and a gaseous atmosphere which is substantially free of gaseous oxygen, the article, alkaline substrate material and gaseous atmosphere being hermetically sealed within an interior of a container, at least a portion of which container is at least partially transparent so as to permit viewing the article from outside the container, the system including an $O_2$ indicator sealed within the interior of said container, capable of indicating the presence of gaseous oxygen with said interior, and the system further including a pH indicator within the interior of said container capable of indicating when said substrate material becomes acidic.

27. A method of preserving an acid-containing article, comprising contacting the article with an alkaline substrate material and a gaseous atmosphere which is substantially free of gaseous oxygen, providing an $O_2$ indicator and a pH indicator, and hermetically sealing the article, alkaline substrate material, gaseous atmosphere, $O_2$ indicator and pH indicator within an interior of a container, at least a portion of which container is transparent so as to permit viewing of the article from outside the container.

* * * * *